United States Patent [19]

Dorgnon et al.

[11] 4,037,770

[45] July 26, 1977

[54] TOOL USING CASELESS AMMUNITION

[75] Inventors: Roger Dorgnon, St. Peray; Marc Combette, Valence; Jean Luthringer, Paris; Jean Ollivier, Valence, all of France

[73] Assignee: Olin Corporation, New Haven, Conn.

[21] Appl. No.: 695,287

[22] Filed: June 11, 1976

[30] Foreign Application Priority Data

June 27, 1975 France ..... 75.20311

[51] Int. Cl.[2] ..... B25C 1/14

[52] U.S. Cl. ..... 227/9

[58] Field of Search ..... 227/8, 9, 10, 11

[56] References Cited

U.S. PATENT DOCUMENTS

| | | | |
|---|---|---|---|
| 3,469,757 | 9/1969 | Kvavle et al. | 227/10 |
| 3,558,032 | 1/1971 | Oefinger | 227/8 |
| 3,973,708 | 8/1976 | Scotoni | 227/10 |
| 3,981,424 | 9/1976 | Maier | 227/10 |

*Primary Examiner*—Granville Y. Custer, Jr.

*Attorney, Agent, or Firm*—William W. Jones; Paul J. Lerner

[57] ABSTRACT

The recess for the ammunition comprises two blind bores whose width is equal to, or greater than, the thickness of the ammunition and whose depth is similar to, or greater than, the diameter of the ammunition, whereby the said blind bores are connected by a groove issuing over a part of the height thereof which is at least equal to the diameter of the ammunition, while the duct or ducts issue into the bottom of at least one of the blind bores.

3 Claims, 3 Drawing Figures

TOOL USING CASELESS AMMUNITION

The present invention relates to a sealing gun using caseless ammunition in the form of compacted propellant pellets with or without primers.

In power-actuated tools of the type disclosed in related United States Application Ser. No. 628,628, filed Nov. 4, 1975 the caseless ammunition is placed in a recess opening into the breech periphery and a duct or ducts linking this recess with a low pressure chamber are provided in the breech. The front wall of the recess serves as an anvil for the percussion striker and must consequently have a planar portion with an adequate surface area. Moreover, it is desirable that the ammunition does not block the duct or ducts so as to prevent, during the combustion of the charge, the carrying of unburned grains of powder towards the low pressure chamber.

The present invention aims at achieving in a simple manner these two objectives, whilst facilitating the machining of the breech.

To this end in the tool according to the invention, the chamber for the ammunition pellet comprises two blind bores each of whose diameter is greater than the thickness of the ammunition pellet and whose depth is similar to, or greater than the diameter of the ammunition pellet. The said blind bores are connected by a slot which is formed with a depth at least equal to the diameter of the ammunition. The combustion gas duct or ducts open into the bottom of at least one of the blind bores.

In the chamber, according to the present invention, the anvil portion has a maximum surface area and the ammunition rests on that portion of the slot wall between the two blind bores. Moreover, the ducts are not blocked by the ammunition which comprises a cylindrical pellet.

Preferably the bores have a conical bottom making it possible to position these ducts closer to the said bottom substantially without decreasing the strength of the breech.

The invention will be better understood from reading the following description with reference to the attached drawings in which.

Figure 1:
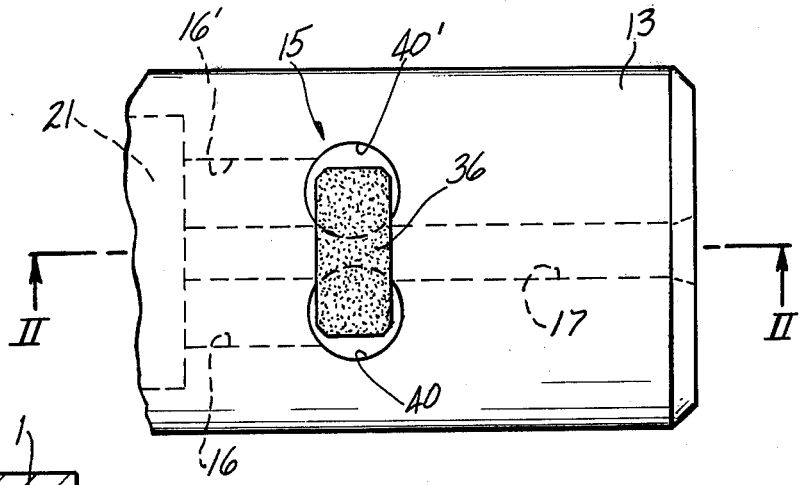
FIG. 1 is a plan view of part of the breech of a tool according to one embodiment of the invention.
Figure 2:
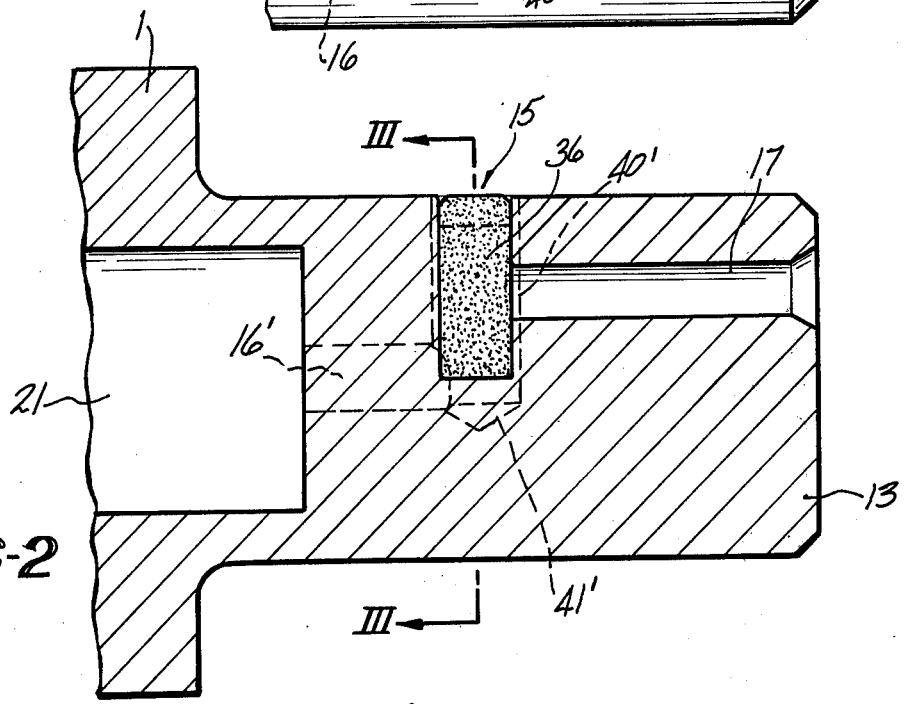
FIG. 2 is a sectional view along the line II-II of FIG. 1.

In the embodiment shown the cylindrical portion 13 of the breech is integral with the barrel 1 of the tool in which is provided the low pressure chamber 21. The recess 15 for ammunition 36 is linked with the low pressure chamber 21 by two ducts 16 and 16' and a passage 17 for a percussion striker (not shown) opens onto the recess 15 opposite to ducts 16 and 16'.

Figure 3:
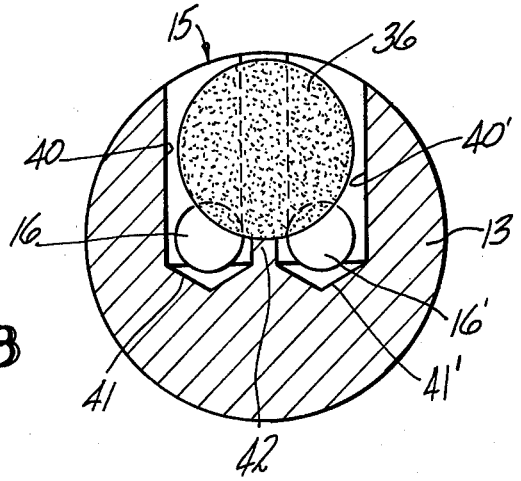
FIG. 3 is a sectional view along the line III-III of FIG. 2.

In the embodiment shown recess 15 comprises two blind bores 40 and 40' terminated by a conical bottom 41 and 41' respectively. The wall separating bores 40 and 40' has partly been milled away to only leave a small wall portion 42 on which rests ammunition 36 on its edge. The arrangement is such that ducts 16 and 16' issue forth close to the bottom of bores 40 and 40' respectively, partly into the conical portions 41 and 41' respectively of the said bores. FIG. 3 in particular shows that ammunition 36 only blocks a very small portion of the intakes to ducts 16 and 16'.

The machining of the recess of the ammunition is simple and economic because it merely requires a boring operation followed by a milling operation. The milling thickness is selected so that the ammunition 36 is maintained between the walls made by the milling tool.

What is claimed is:

1. A power-actuated tool of the type utilizing caseless ammunition pellets contained in a recess in a cylindrical breech, said recess for the ammunition comprising two blind bores each of whose diameter is greater than the thickness of the ammunition pellet and whose depth is similar to or greater than the diameter of the ammunition pellet, said blind bores being connected by a slot having a depth which is at least equal to the diameter of the ammunition pellet and further comprising at least one combustion gas duct opening into the bottom of at least one of the blind bores.

2. The tool of claim 1, wherein said bores have a conical bottom surface.

3. The tool of claim 1, wherein said breech is integral with a barrel member of the tool.

* * * * *